United States Patent [19]

Stegmaier et al.

[11] 4,099,828

[45] Jul. 11, 1978

[54] BLADE-TYPE FUSE CLIP WITH FIELD INSTALLABLE REJECTION MEANS

[75] Inventors: Louis T. Stegmaier, Plainville; Howard Reynolds, New Britain, both of Conn.

[73] Assignee: General Electric Company, New York, N.Y.

[21] Appl. No.: 840,456

[22] Filed: Oct. 7, 1977

[51] Int. Cl.[2] ..... H01H 85/24

[52] U.S. Cl. ..... 339/258 F; 337/226; 339/259 F

[58] Field of Search ..... 339/150 F, 184 R, 186 R, 339/219 F, 252 F, 253 F, 256 C, 258 F, 259 F, 262 F; 337/225, 226, 227

[56] References Cited

U.S. PATENT DOCUMENTS 4,037,917 7/1977 Clement ..... 339/259 F

*Primary Examiner*—Neil Abrams

*Attorney, Agent, or Firm*—Robert A. Cahill; Walter C. Bernkopf; Frank L. Neuhauser

[57] ABSTRACT

A fuse clip includes a pair of clamping arms defining a fuse terminal blade receiving slot. A rejector pin, once inserted through a hole in one of the clamping arms, is prevented from being withdrawn by a spring retainer clip. The pin, which spans the slot to accept only fuse terminal blades keyed with a special notch, carries a loaded compression spring serving to rigidify its cantilever mounting to the one clamping arm.

8 Claims, 6 Drawing Figures

BLADE-TYPE FUSE CLIP WITH FIELD INSTALLABLE REJECTION MEANS

BACKGROUND OF THE INVENTION

The present invention relates to fuse clips, and more particularly, to cartridge fuse clips capable of rejecting improper fuses.

Cartridge fuses are available in a wide variety of current ratings and interrupting capacities (IC). At least in one case, cartridge fuses of the same current rating but of different interrupting capacities are of substantially the same physical size. Specifically, the current limiting, high IC class R cartridge fuse is essentially identical in physical dimensions to the non-current limiting, low IC class H cartridge fuse. Consequently, the class H and class R fuses are interchangeable insofar as the fuse clip is concerned. Obviously, they are not interchangeable from the standpoint of circuit protection. If a class H fuse is inadvertently inserted in a fuse clip installed in a circuit calling for class R fuse protection, a potentially hazardous situation is created. To discourage this, industry has resorted to keying one terminal of the class R fuse and a specially designed rejection fuse clip which accepts the keyed end terminal of a class R fuse but does not accept the unkeyed end terminal of a class H fuse. In the case of class R fuses having blade-type end terminals, keying is achieved by cutting a notch in one of the terminal blades. The rejection fuse clip is then provided with an interference member which is accommodated in the notch of a class R fuse terminal blade as it is inserted between the clip clamping arms. The interference member however engages the unnotched, smooth edge of a class H fuse terminal blade to obstruct its insertion between the clamping arms. Rejection fuse clips of this type are exemplified in U.S. Pat. Nos. 2,558,581; 3,858,058; and 4,037,917.

Since both class R and class H fuses are widely used, manufacturers are forced into the uneconomical proposition of having to manufacture and stock both the rejecting and the non-rejecting types of fuse clips. Since the fuse clips are assembled in electrical equipment prior to shipment, the equipment itself must also be stocked or, alternatively, the type of fuses the equipment is to utilize must be known at the time of assembly.

To mitigate the additional manufacturing expense engendered by the necessity of supplying both types of fuse clips, manufacturers have resorted to providing with the equipment a basic non-rejecting type of fuse clip capable of accepting both class H and class R cartridge fuses and offering a kit including a rejection member which is physically assembled to the basic fuse clip by the customer at the time the equipment is installed.

It is accordingly an object of the present invention to provide a fuse clip having improved field installable interference means for converting the fuse clip from a non-rejecting mode to a rejecting mode.

An additional object of the present invention is to provide a fuse clip of the above character, wherein the interference means may be assembled to the fuse clip in the field with minimal time and effort and without the necessity of tools.

A further object is to provide a fuse clip of the above character wherein the interference means, once installed, cannot be readily dismantled.

Still another object of the invention is to provide a rejecting type fuse clip of the above character which is inexpensive to manufacture and reliable in operation.

Other objects of the invention will in part be obvious and in part appear hereinafter.

SUMMARY OF THE INVENTION

Generally stated, the present invention provides a fuse clip having a pair of clamping arms upstanding from a common base in parallel, spaced apart relation to define therebetween a slot for receiving any bladed terminal of a cartridge fuse. To convert the fuse from a non-rejecting mode to a rejecting mode, interference means is assembled to one of the clamping arms for extension transversely through the slot to obstruct the insertion between the clamping arms of a bladed fuse terminal which has not been keyed with a special, downwardly opening notch. On the other hand, the interference means does not obstruct full downward insertion into the slot of a bladed fuse terminal having the keying notch enabling the fuse terminal blade to clear the interference means.

The interference means, which in accordance with the present invention is field installable, comprises a headed rejector pin carrying a helical compression spring on its shank. The free end of the shank is inserted through a clearance hole in the one clamping arm to present an annular groove in the shank free-end portion beyond the side of the one clamping arm opposite the slot, while at the same time compressing the helical spring between the head and the one clamping arm. A spring retainer clip lodged in the groove prevents withdrawal of the pin and the compressed state of the helical spring is sustained to rigidify the cantilever mounting of the rejector pin to the one clamping arm. Preferably, a metal sleeve is carried on the portion of the rejector pin shank spanning the slot, i.e., intermediate the one clamping arm and the compressed helical compression spring, to facilitate insertion of a keyed fuse terminal blade and to locate the spring on the pin shank where it cannot be damaged by fuse insertion.

Preferably, the spring clip is C-shaped and is lodged in the shank groove prior to assembly of the interference means to the one clamping arm; the clip serving to hold the compressed helical spring and sleeve captive on the pin shank. The shank groove is provided with a conical bottom surface with its smallest diameter part nearest the pin head. Upon insertion of the free end of the pin shank through the hole in the one clamping arm, the spring clip is shifted to the smallest diameter part of the groove where it can be radially compressed by engagement with the hole periphery to permit its passage through the hole. When the spring clip clears the exit end of the hole, it springs to its normal diameter which exceeds the hole diameter. The compressed helical spring, in biasing the rejector pin back out of the hole, shifts the spring clip to the largest diameter part of the groove where it becomes lodged to block withdrawal of the rejector pin. The exit end of the hole is preferably countersunk to obscure access to the spring clip and thus discourage removal of the spring clip in an attempt to defeat the rejection feature once it has been implemented.

The invention accordingly comprises the features of construction, arrangement of parts and combination of elements which will be exemplified in the construction hereinafter set forth, and the scope of the invention will be indicated in the claims.

For a fuller understanding of the nature and objects of the invention, reference should be had to the following detailed description taken in connection with the accompanying drawings, in which.

Like reference numerals refer to corresponding parts throughout the several views of the drawing.

DETAILED DESCRIPTION

Figure 1:
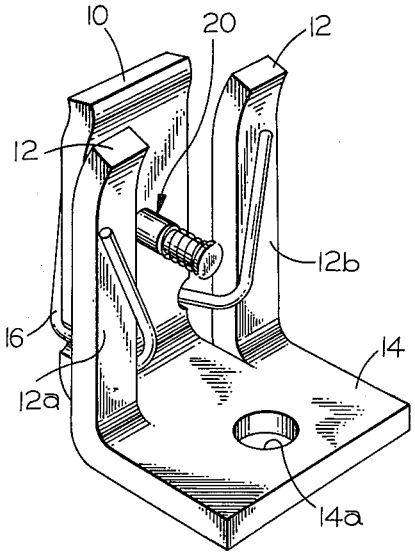
FIG. 1 is a perspective view of a fuse clip constructed in accordance with the present invention and seen in its fuse rejecting mode.
Figure 2:
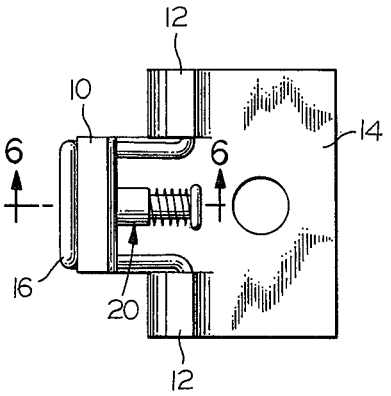
FIG. 2 is a plan view of the fuse clip of FIG. 1.

The fuse clip of the present invention, as best seen in FIGS. 1 and 2, comprises a pair of clamping arms 10 and 12 upstanding from a common base 14 and defining therebetween a slot for receipt of the bladed end terminal of a cartridge fuse. Preferably, clamping arm 12, defining one side of this slot, is constituted by separate, spaced apart clamping arm components **12*a*, 12*b*, to permit the forming of the clamping arms 10, 12 and base 14 from a single piece of conductive metal stock, such as copper. A reinforcement spring 16 acts on clamping arm 10 and opposed clamping arm components 12*a*, 12*b* to enhance the contact pressure exerted by the clamping arms on a fuse terminal blade accommodated in the slot. A hole 14*a* provided in base 14** facilitates mounting the fuse clip in electrical contacting engagement with a device terminal strap (not shown).

Figure 5:
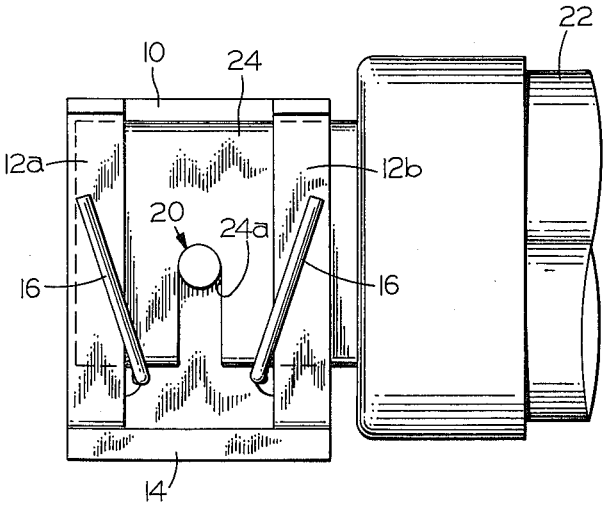
FIG. 5 is a plan view of the spring clip of FIG. 1, illustrating its acceptance of a bladed fuse terminal keyed with a special, downwardly opening notch.

The fuse clip, as described thus far, is conventional and capable of accepting in its slot any cartridge fuse bladed end terminal, that is, capable of accepting, for example, both class H and class R fuses. To render the fuse clip capable of accepting class R fuses, but rejecting class H fuses, interference means, generally indicated at 20, is cantilevered mounted to clamping arm 10 for transverse extension through the clip slot and the gap between clamping arm components **12*a*, 12*b*. With the interference means in place, the fuse clip, as seen in FIG. 5, can accept only a class R fuse 22 having an end terminal blade 24 in which is keyed a downwardly opening notch 24*a* into which the interference means is accommodated during downward insertion of the terminal blade into the clip slot. It will be appreciated, that a fuse terminal blade having an uninterrupted bottom edge, such as is the case of a class H fuse terminal blade, will be obstructed from full insertion into the clip slot by the presence of the interference means 20**.

It is intended, in accordance with the present invention, that the fuse clip of FIG. 1, but devoid of interference means 20, is provided as original equipment with the electrical device purchased by the user. Without the interference means, the clip is of the non-rejecting type or mode, capable of accepting both class H and class R fuses. If the device is to be wired into a circuit calling for class R fuse protection, the user obtains the interference means from the device manufacturer as a field installable conversion kit for assembly to the fuse clip pursuant to converting it from its non-rejecting mode to its rejecting mode.

Figure 3:
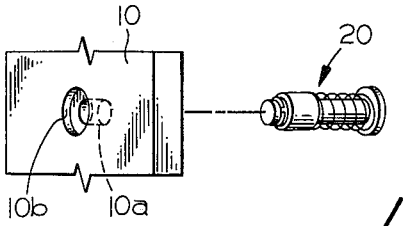
FIG. 3 is a fragmentary, exploded perspective view of a portion of the spring clip of FIG. 1 illustrating the installation of interference means thereto for converting it from a non-rejecting mode to a rejecting mode.
Figure 4:
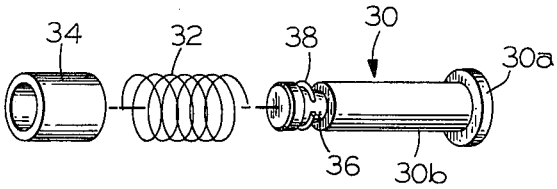
FIG. 4 is an exploded, assembly view in perspective of the interference means seen in FIG. 1.
Figure 6:
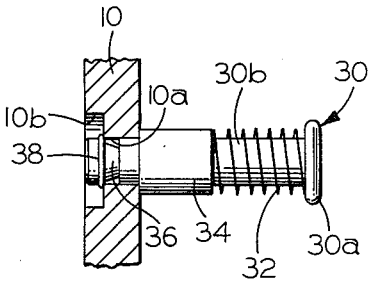
FIG. 6 is a sectional view taken along line 6—6 of FIG. 2.

The interference means 20, as best seen in FIGS. 3, 4 and 6, includes, in accordance with the present invention, a rejector pin, generally indicated at 30, having a head **30*a* and an elongated shank 30*b*. Carried on the shank is a compression spring 32 and a metal sleeve 34, with the compression spring nearest the rejector pin head. Formed in shank 30*b* adjacent its free end is an annular groove 36 having a conical shaped bottom surface or neck and straight side walls. Lodged in this groove is a C-shaped spring retained clip 38 of circular cross-section. In its relaxed state, spring clip 38 has an inner diameter which is less than the diameter of shank 30*b* and an outer diameter greater than the shank diameter. The outer diameter of the spring clip 38 is also in excess of the inner diameter of sleeve 34, such that the spring clip is capable of holding the sleeve and helical compression spring captive on the shank of rejector pin 30** and thus holds the interference means in assembly during shipment and subsequent field installation.

The rejector pin may take the form of a pin fastener of the design currently being marketed by the Standard Press Steel Company under the designation "Quick-Click". The fuse clip of the present invention utilizes the type A, tamper-proof design, wherein removal of the spring clip is very difficult without the use of a special tool.

To install the interference means 20, the free end of the rejector pin shank **30*b* is manually inserted into a close-fitting clearance hole 10*a* formed in clamping arm 10. The outer diameter of spring clip 38 in its relaxed condition is greater than the diameter of the hole 10*a*, and thus the spring clip is shifted to the necked-down, smallest diameter end of conical groove 36 upon engagement with the hole periphery. Continued insertion pressure, which may be readily exerted by one's fingers, forces the spring clip into a radially compressed state where its outer diameter is less than the hole diameter; radial spring clip compression being accommodated by the reduced diameter at the end of the groove where the spring clip has been shifted. The rejector pin 30 may then be pushed through hole 10*a*, and, in the process, helical compression spring 32 is compressed. When spring clip 38 clears the exit end of hole 10*a*, it springs to its relaxed state, wherein its outer diameter again exceeds the hole diameter. The rejector pin may then be released, whereupon the compression spring partially discharges, shifting the pin in the withdrawal direction. Spring clip 38 is thus shifted to the largest diameter end of conical groove 36 where is becomes lodged to prevent further withdrawal of the rejector pin. It is seen that the larger diameter of the groove where the spring clip is now positioned precludes radial compression of the spring clip, and thus the rejector pin cannot be forced back out of the hole 10*a*. Helical compression spring 32 remains substantially charged and thus imparts substantial rigidity to the cantilever mounting of the interference means 20 to clamping arm 10. It will be noted that sleeve 34 is situated on that portion of the rejector pin shank spanning the fuse terminal blade receiving slot to serve as a smooth peripheral bearing surface capable of riding smoothly into notch 24*a* of a class R fuse end terminal blade 24. As a consequence, fuse insertion is facilitated. Moreover, with sleeve 34 in engagement with spring clip 38**, the parts of the interference means are reliably held in assembly.

Preferably, the exit end of hole 10*a* in clamping arm 10 is countersunk, as indicated at 10*b* in FIGS. 3 and 6 so as to obscure spring clip 38 and thereby discourage attempts to dislodge the spring clip from groove 36 for the purpose of defeating the rejection feature after it has been implemented. In this connection, a helical compression spring is preferably formed having a fully compressed length sufficient to prevent the rejector pin 30 from being pushed sufficiently through hole 10*a* to expose the spring clip 28 beyond the countersunk portion 10*b* of the hole.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A rejector fuse terminal clip for accepting a fuse terminal blade keyed with a special notch and rejecting a fuse terminal blade lacking the special notch, said fuse clip comprising, in combination:

A. first and second clamping arms upstanding from a common base in parallel, spaced apart relation to define therebetween a fuse terminal blade receiving slot;

B. means forming a hole in said first clamping arm and an interruption in said second clamping arm in opposed relation across said slot from said hole; and C. interference means cantilever mounted by said first clamping arm for extension across said slot and through said interruption in said second clamping arm to reject insertion into said slot of a fuse terminal blade lacking the special notch, said interference means including (1) a rejector pin having an enlarged head and a shank of a diameter conforming to the diameter of said hole, (2) means forming an annular groove in said shank adjacent the free end thereof remote from said head, (3) a helical compression spring carried on said shank intermediate said head and said groove, and (4) a spring clip lodged in said groove and having a diameter exceeding the diameter of said hole, (5) said shank extending through said hole to dispose said groove on the opposite side of said first clamping arm from said slot, said spring clip, as lodged in said groove, preventing removal of said rejector pin from said hole, and said compression spring being compressed between said head and said first clamping arm to rigidify the cantilever mounting of said rejector pin to said clamping arm.

2. The fuse terminal clip defined in claim 1, wherein the end of said hole removed from said slot is countersunk to obscure said spring clip as lodged in said groove.

3. The fuse terminal clip defined in claim 1, wherein said interference means further includes a sleeve carried on the portion of said rejector pin shank located in said slot, said compression spring being compressed between said rejector pin head and said sleeve.

4. The fuse terminal clip defined in claim 3, wherein the end of said hole removed from said slot is countersunk to obscure said spring clip as lodged in said groove.

5. The fuse terminal clip defined in claim 1, wherein said second clamping arm is constituted by a pair of separate, clamping arms spaced apart to create said interruption.

6. The fuse terminal clip defined in claim 1, wherein said groove in said rejector pin shank has a conical bottom surface with the widest end nearest said shank free end, said spring clip of C-shaped configuration being shifted to the narrowest end of said groove and compressed by insertion of the shank free end through said hole from the slot side of said first clamping arm, and, upon emerging from said hole, said spring clip expands and is shifted to the widest end of said groove by said compression spring to assume its normal diameter in excess of the diameter of said hole, thereby preventing removal of said rejector pin.

7. The fuse terminal clip defined in claim 6, wherein said interference means further includes a sleeve carried on the portion of said rejector pin shank located in said slot, said compression spring being compressed between said rejector pin head and said sleeve.

8. The fuse terminal clip defined in claim 7, wherein the end of said hole removed from said slot is countersunk to obscure said spring clip as lodged in said groove.

* * * * *